US010143865B2

(12) United States Patent
Franke et al.

(10) Patent No.: US 10,143,865 B2
(45) Date of Patent: Dec. 4, 2018

(54) HARNESS AND LOAD BEARING SYSTEMS

(71) Applicants: Thomas Zebulon Franke, Salt Lake City, UT (US); Bill Belcourt, Salt Lake City, UT (US); Brendan Perkins, Salt Lake City, UT (US); Benjamin Mark Wheeler, Salt Lake City, UT (US); Jake Hall, Highland, UT (US)

(72) Inventors: Thomas Zebulon Franke, Salt Lake City, UT (US); Bill Belcourt, Salt Lake City, UT (US); Brendan Perkins, Salt Lake City, UT (US); Benjamin Mark Wheeler, Salt Lake City, UT (US); Jake Hall, Highland, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 18 days.

(21) Appl. No.: 14/873,428

(22) Filed: Oct. 2, 2015

(65) Prior Publication Data

US 2016/0096044 A1 Apr. 7, 2016

Related U.S. Application Data

(60) Provisional application No. 62/060,117, filed on Oct. 6, 2014.

(51) Int. Cl.
*A62B 35/00* (2006.01)
*B65H 69/06* (2006.01)

(52) U.S. Cl.
CPC ..... *A62B 35/0025* (2013.01); *A62B 35/0006* (2013.01); *B65H 69/06* (2013.01)

(58) Field of Classification Search
CPC .. B65H 69/06; A62B 35/0025; A62B 35/0006
See application file for complete search history.

(56) References Cited

U.S. PATENT DOCUMENTS 311,889 A * 2/1885 Powers ..... A62B 35/0025 182/6
416,550 A * 12/1889 Betten ..... A62B 35/0025 182/6

(Continued)

FOREIGN PATENT DOCUMENTS

CA 2846244 A1 * 9/2014 ..... A61B 17/0401
CA 2846244 A1 * 9/2014 ..... A61B 17/0401

(Continued)

OTHER PUBLICATIONS

Braided. (n.d.). Dictionary.com Unabridged. Retrieved Sep. 12, 2017 from Dictionary.com websitehttp://www.dictionary.com/browse/braided.*

*Primary Examiner* — Katherine W Mitchell
*Assistant Examiner* — Candace L Bradford
(74) *Attorney, Agent, or Firm* — Trent Baker; Baker & Associates PLLC

(57) ABSTRACT

One embodiment of the present invention is related to a harness system including a waist member and a leg loop member. The waist member is configured to encircle the naval region of the user and form a continuous loop. The leg loop member is configured to encircle the legs of the user. The leg loop member nay also be coupled to the waist member via a third loop. The leg loop member includes a continuous cord with at least two unbraided regions and at least one splice coupling. The unbraided regions are disposed between braided regions and are disposed on the leg loop member to correspond to the user's legs. The unbraided regions further comprise a plurality of separated strands oriented substantially parallel and equidistant to one another.

20 Claims, 5 Drawing Sheets

(56) References Cited

U.S. PATENT DOCUMENTS 1,328,406 A * 1/1920 Van Alstyn ..... A61F 13/64 2/314
3,937,407 A * 2/1976 Matsuo ..... A62B 35/04 244/151 R
4,618,026 A * 10/1986 Olson ..... A62B 35/04 182/4
5,039,168 A * 8/1991 Baymak ..... B60R 21/18 297/471
5,615,750 A * 4/1997 Phillips ..... A62B 35/0031 182/6
5,699,657 A * 12/1997 Paulson ..... B65H 69/06 28/142
5,901,632 A * 5/1999 Ryan ..... B65H 69/06 57/22
6,105,169 A * 8/2000 Colorado ..... A62B 35/0025 182/6
6,283,248 B1 * 9/2001 Groover ..... A62B 35/0025 182/6
7,743,885 B2 * 6/2010 Martin ..... A45F 3/12 182/230
D694,414 S * 11/2013 Sparkes ..... D24/190
9,186,536 B2 * 11/2015 Strachan ..... A63B 21/0557
9,259,605 B1 * 2/2016 Puig ..... A63B 7/00
2008/0282442 A1 * 11/2008 Bauvois ..... A41D 13/0007 2/79
2013/0139741 A1 * 6/2013 Fields ..... B63B 21/20 114/230.21
2016/0096043 A1 * 4/2016 Blondeau ..... A62B 35/0025 182/3
2016/0346571 A1 * 12/2016 Huber ..... A62B 35/0012

FOREIGN PATENT DOCUMENTS

DE 102012000182 7/2013
DE 102012000182 A1 * 7/2013 ..... A62B 35/0025
DE 102012000182 A1 * 7/2013 ..... A62B 35/0025
EP 0844901 10/2000
EP 1068881 A1 * 1/2001 ..... A62B 35/0025
EP 1068881 A1 * 1/2001 ..... A62B 35/0025
EP 1834543 10/2007
EP 2383018 A1 * 11/2011 ..... A45F 3/14
EP 2383018 A1 * 11/2011 ..... A45F 3/14
FR 2865410 A1 * 7/2005 ..... A62B 35/0012
GB 20652 10/1915
GB 468595 7/1937
WO WO-2011107676 A1 * 9/2011 ..... A62B 35/0025
WO WO 2011107676 A1 * 9/2011 ..... A62B 35/0025

* cited by examiner

HARNESS AND LOAD BEARING SYSTEMS

FIELD OF THE INVENTION

The invention generally relates to harnesses and load bearing strap type applications. In particular, the present invention relates to braided and unbraided members forming harnesses and other load bearing systems.

RELATED APPLICATIONS

This application claims priority to U.S. provisional application Ser. No. 62/060,117 filed Oct. 6, 2014, the contents of which are incorporated by reference.

BACKGROUND OF THE INVENTION

Harnesses are used to intercouple a user with some form of safety line such as a rope or cable. The most common type of harness used in outdoor sports is coupled around a user's waist and legs. In various outdoor sports, a harness is used during ascent and descent of technical terrain to enable a user to intercouple with a rope. For example, in roped climbing-related activities, an individual will generally wear a harness to provide a coupling point for the rope. Likewise, during roped descents and rappels, a harness is necessary to facilitate the controlled rope descent.

Various types of harnesses are used based on desired performance characteristics corresponding to a particular activity. These characteristics include weight, adjustment range, usability, safety, strength, etc. Most rock climbing and rappelling type harnesses include a waist belt and a set of leg loops interconnected at a frontal location. The waist belt and leg loops must meet certain industry-certified strength parameters while also providing a minimum amount of comfort to the user. For example, the waist belt and leg loops generally include wide regions designed to distribute forces across the corresponding anatomical regions of the user.

In many applications, the primary performance characteristic of a harness is the overall weight. The evolution of harnesses has therefore been primarily toward lighter-weight systems, including various stitching and fabric selection techniques to minimize weight while maintaining minimum strength and comfort. For example, heavier materials are often stitched between regions of lightweight narrow materials to maintain comfort but minimize weight. Unfortunately, the technique of stitching multiple materials together still requires heavy stitching to intercouple the regions while maintaining necessary strength.

Therefore, there is a need in the industry for a non-stitch based system for reducing the overall weight of a harness or other load bearing strap type applications.

SUMMARY OF THE INVENTION

The present invention relates to harnesses and load bearing strap type applications. One embodiment of the present invention is related to a harness system including a waist member and a leg loop member. The waist member is configured to encircle the naval region of the user. The leg loop member is configured to encircle the legs of the user. The leg loop member may also be coupled to the waist member via a third loop. The leg loop member includes a cord with at least two unbraided regions and at least one splice coupling. The unbraided regions are disposed between braided regions and are disposed on the leg loop member to correspond to the user's legs. The unbraided regions further comprise a plurality of separated strands oriented substantially parallel and equidistant to one another. A second embodiment of the present invention relates to a method of manufacturing a harness, including providing a waist member and leg loop member, splice coupling the two ends of the cord, and unbraiding at least two separated portions of the middle region to form unbraided regions.

Embodiments of the present invention represent a significant advancement in the field of harnesses and load bearing strap systems. Conventional harnesses fail to significantly minimize weight while maintaining necessary comfort and strength. Embodiments of the present invention incorporate unbraided wider regions and braided narrower regions of the same cord, thereby eliminating the necessary stitch type couplings of conventional lightweight harnesses. Likewise, embodiments of the present invention incorporate a spliced intercoupling of the ends of a cord so as to form a continuous loop without any type of independent stitch coupling.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention relates to harnesses and load bearing strap type applications. One embodiment of the present invention is related to a harness system including a waist member and a leg loop member. The waist member is configured to encircle the naval region of the user. The leg loop member is configured to encircle the legs of the user. The leg loop member may also be coupled to the waist member via a third loop. The leg loop member includes a cord with at least two unbraided regions and at least one splice coupling. The unbraided regions are disposed between braided regions and are disposed on the leg loop member to correspond to the user's legs. The unbraided regions further comprise a plurality of separated strands oriented substantially parallel and equidistant to one another.

A second embodiment of the present invention relates to a method of manufacturing a harness, including providing a waist member and leg loop member, splice coupling the two ends of the cord, and unbraiding at least two separated portions of the middle region to form unbraided regions. Also, while embodiments are described in reference to a harness leg loop member, it will be appreciated that the teachings of the present invention are applicable to other areas, including but not limited to other load bearing strap type applications such as harness waist members, belay loops, pole hand straps, etc.

The following terms are defined as follows:

Braiding—a type of interweaving in which individual fibers are substantially parallel and interwoven around one another.

Weaving—a type of interweaving in which an orthogonal fiber is interwoven between a set of substantially parallel fibers.

Cord—an elongated member consisting of at least three separate monolithic strands which may be braided together or unbraided. "Monolithic" refers to the length of the strands. For example, DYNEEMA is a type of braided fabric cord.

Webbing—an elongated flat member comprising a set of woven fibers. For example, a common type of webbing comprises colored nylon and is often sold per foot at an outdoor retail store such as REI.

Cable—an elongated member comprising a single strand or a plurality of twisted non-braided strands. For example, a twisted strand metal cable is often used to secure items with a key lock.

Splice—a type of coupling between one end of a cord and another portion of a cord. A splice includes braiding the end of the cord with either another end region or a middle region.

Continuous loop—a mathematical relationship in which an elongated structure forms a loop with no points of discontinuity. For example, a rubber band forms a mathematically continuous loop of rubber because there is no end region. A continuous loop may include various shapes such as an oval, FIG. 8, etc.

Figure 1:
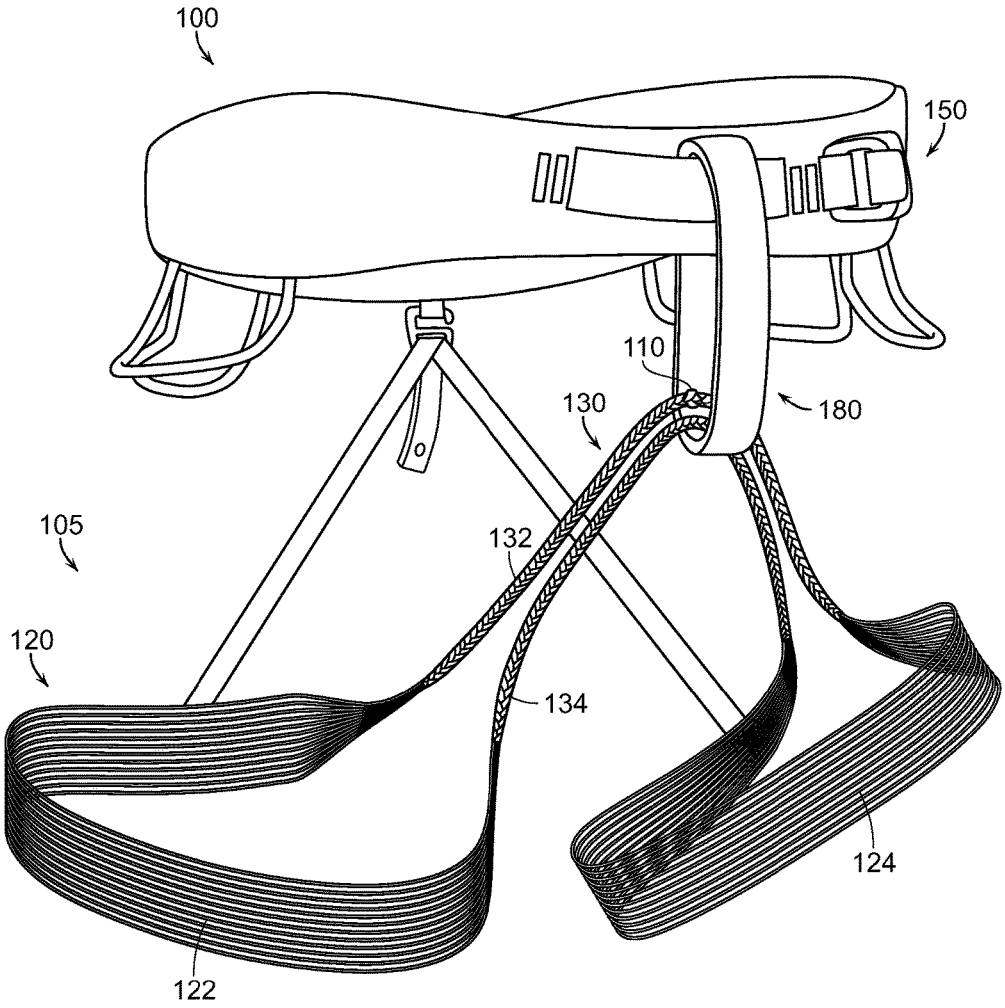
FIG. 1 illustrates a harness system in accordance with embodiments of the present invention.

Reference is initially made to FIG. 1, which illustrates a harness system, designated generally at 100. The harness system 100 includes a waist member 150, a leg loop member 105, and a coupler 180. The waist member 150 forms a continuous loop configured to encircle the waist region of a user. As defined above, the term "continuous loop" refers to a mathematically continuous shape that does not substantially include any points of discontinuity. The leg loop member 105 substantially encircles the legs of the user. The illustrated waist member 150 includes various undesignated components unrelated to the present invention, including gear loops, adjustment mechanisms, adjustable rear leg loop height mechanisms, etc. The illustrated coupler 180 extends around both the waist member 150 and leg loop member 105. Various other optional well known optional straps or systems may be incorporated in the harness system 100 in accordance with embodiments of the present invention.

The illustrated leg loop member 105 forms a continuous loop which is releasably shaped to substantially encircle the legs of user and form a narrow middle region. The leg loop member 105 includes a splice coupling 110, braided regions 130, and unbraided regions 120. The terms "splice", "splice coupling" or "spliced coupling" all refer to an interwoven coupling of the cord as will be discussed below. The leg loop member 100 comprises a cord of interwoven fibers, which meets the necessary tensile and shear strength parameters to function as a harness leg loop. As defined above, a cord is distinguishable from a cable and a piece of webbing in that the constituent fibers are interwoven or braided in a substantially aligned configuration. In contrast, a cable includes fibers which are twisted, and webbing includes fibers which are orthogonally woven. The cord is therefore an elongated structure of braided fiber members. The default configuration of a lengthwise portion of cord is therefore a braided region because the fibers are braided together. Throughout the application, a reference to a "braided region" therefore indicates that a particular lengthwise section remains in a braided state. One example of a cord is sold under the brand name DYNEEMA and is composed of fabric-type fibers. It will be appreciated that other cords such as those made of metal may be used in accordance with embodiments of the same invention.

The spliced coupling 110 is an interwoven coupling between portions of the cord. As defined above, a splice coupling includes interweaving the fibers to form a coupling that tightens in response to tensile separation forces. Various splicing techniques may be used, including but not limited interweaving sub-strands of the two ends of the cord within one another. The splicing technique may be combined with one or more sleeves to circumferentially compress the splice, protect the splice, and/or avoid expansion. The splicing technique may be described as analogous in function to the commonly known toy called a "finger torture" device in that the interwoven splicing pattern is configured to bind the fibers against one another, thereby strengthening the coupling in response to tensile expansion forces. The splice coupling 110 is a unique type of coupling because it does not require any additional materials or operations to effectuate the coupling. In contrast, stitch type couplings between regions of woven members (i.e. webbing) include an external stitch routed through both the woven members. Likewise, mechanical couplings require some type of compression apparatus to couple two members. Therefore, the splice coupling 110 reduces overall system weight while maintaining the necessary strength by eliminating the additional coupling components of conventional coupling schemes.

Figure 2:
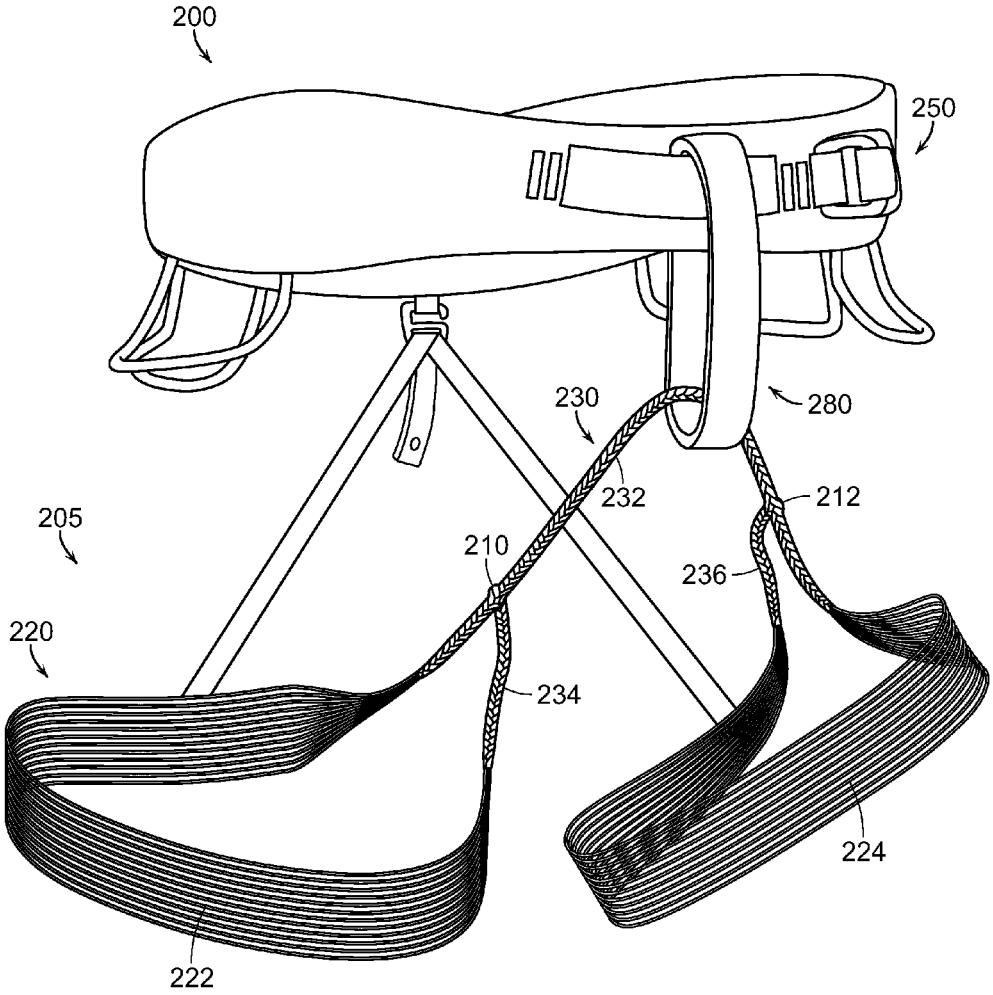
FIG. 2 illustrates a harness system in accordance with an alternative embodiment of the present invention.

A splice coupling may be created between two end regions of cord (coupling 110 shown in FIG. 1) or between one end region of cord and a middle region of cord (coupling 210, 212 shown in FIG. 2). The spliced coupling 110 of the embodiment illustrated in FIG. 1 is disposed in a middle region of the leg loop member 100 substantially corresponding to the location of coupling member 180. The spliced coupling 110 is shown as having a slightly larger cross sectional diameter for illustration purposes only. The actual increase in diameter of the spliced coupling 110 may be greater or smaller depending on the composition and tensile force upon a particular region. It will be appreciated that various other spliced couplings may be included without effecting the functionality of the system. For example, the cord may include three independent segments that are lengthwise-splice coupled to form what appears as a single cord.

The braided regions 130 include lengthwise regions of the cord in which the fibers remain in the default interwoven or braided configuration. In the illustrated embodiment of FIG. 1, the braided regions include a top braided region 132 and a bottom braided region 134 disposed in the middle narrow region of the continuous loop structure of the cord forming the leg loop member 105. The braided regions 130 are therefore lengthwise disposed between the unbraided regions 120. In addition, the top and bottom braided regions 132, 134 are substantially parallel to one another. The spliced coupling 110 is disposed on the top braided region 132. The top and bottom braided regions 132, 134 are oriented in the narrow middle portion to facilitate a coupling region of the leg loop member 105 which enables the coupler 180 to encircle both the top and bottom braided region 132, 134.

The unbraided regions 120 further include a separate left and right unbraided region 122, 124 corresponding to each of the user's legs. The unbraided regions 120 refer to lengthwise sections of the cord in which the constituent fibers are separated in a substantially parallel and equidistant configuration. The functionality of separating the fibers changes the cross sectional shape of the unbraided regions to be substantially flat. In general, it is advantageous to include a substantially flat wider region in proximity to a user's legs for purposes of comfort. Providing the comfort of the wide unbraided regions at the points of user leg contact while maintaining the overall strength and reduced weight of the cord is a unique aspect of this invention. The process of creating the unbraided regions 120 may be performed across a discrete intermediate lengthwise segment of cord. Various unweaving processes may be implemented which limit the unweaving to a particular region. The illustrated left and right unbraided regions 122, 124 are disposed at particular lengthwise intermediate locations on the continuous loop structure of cord so as to substantially encircle each of the user's legs. The unbraided regions 122, 124 are also disposed between the braided regions 132, 134. The illustrated left and right unbraided regions 122, 124 do not overlap one another and therefore only partially surround a user's leg. The unbraided regions 120 of the leg loop member 100 include separated and substantially aligned constituent fibers of the cord. Portions of a braided cord may be unbraided without cutting the cord. The fibers are aligned and separated in a substantially equidistant parallel configuration to distribute shear forces across the fibers, thereby substantially maintaining the tensile strength of the cord. The fibers of the unbraided regions may be supported in the substantially equidistant parallel configuration by intercoupling with an optional separator (not shown). The separator may be a flat woven fabric, a plastic guide, etc. Positioning of the fibers may include various techniques such as interweaving a crossfiber with the separator, a pressure/temperature welding with the separator, a set of physical channels within the separator, etc. The unbraided regions may also be covered by an optional cover member (not shown) extending lengthwise over the unbraided regions 122, 124.

Reference is next made to FIG. 2, which illustrates an alternative harness system 200 including a waist member 250, coupler 280, and leg loop member 205. The alternative system 200 incorporates an alternative leg loop member 205 comprising a first and second spliced coupling 210, 212, braided regions 230, and unbraided regions 220. The braided regions 230 include left braided region 234, middle braided region 232, and a right braided region 236. The left braided region 234 is coupled directly to the middle braided region 232 via the first spliced coupler 210. The right braided region 236 is coupled directly to the middle braided region 232 via the second spliced coupler 212. The unbraided region 220 includes similar left and right unbraided regions 222, 224. The leg loop member 205 thereby still forms a continuous mathematical structure but not a loop. Rather, the end regions of a cord are each coupled within an intermediary region forming two loops and a middle region. As discussed above, spliced couplings may be made between one end region and a middle region.

Figure 3A:
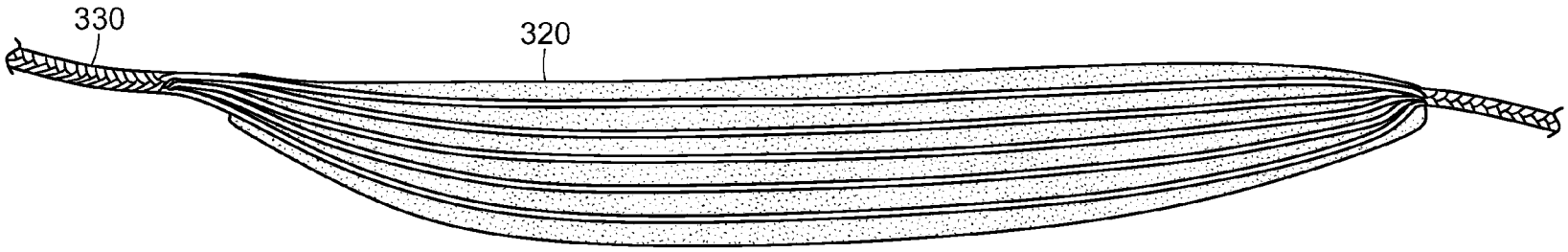
FIGS. 3A and 3B illustrate a cord member with an unbraided aligned region and a second cord member with an unbraided misaligned region.
Figure 3B:
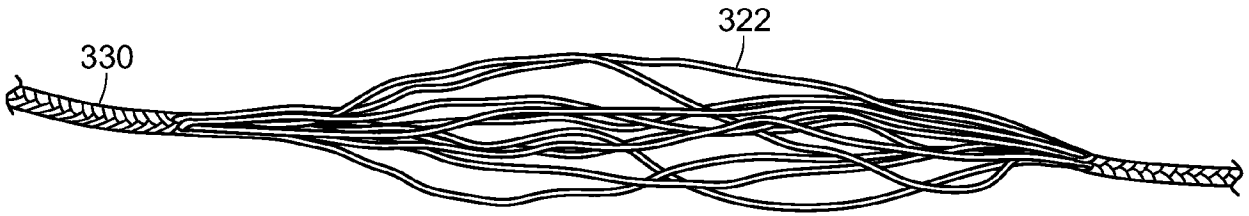

Reference is next made to FIG. 3, which illustrates two cord sections to illustrate the process of forming an unbraided region. Initially, a section of braided cord 330 is unwoven across a particular lengthwise region. If the lengthwise region is between two braided regions, the fibers in the unwoven section will default to a misaligned unbraided configuration as shown in region 322. Therefore, to maintain a manual alignment of the misaligned fibers of region 322 in the substantially parallel equidistant configuration of region 320, an optional separator member may be incorporated to maintain the aligned configuration and distribute across the fibers. As discussed above, the separator may be interwoven, glued, compresses, etc. over the fibers to maintain the substantially equidistant and parallel alignment.

Figure 4A:
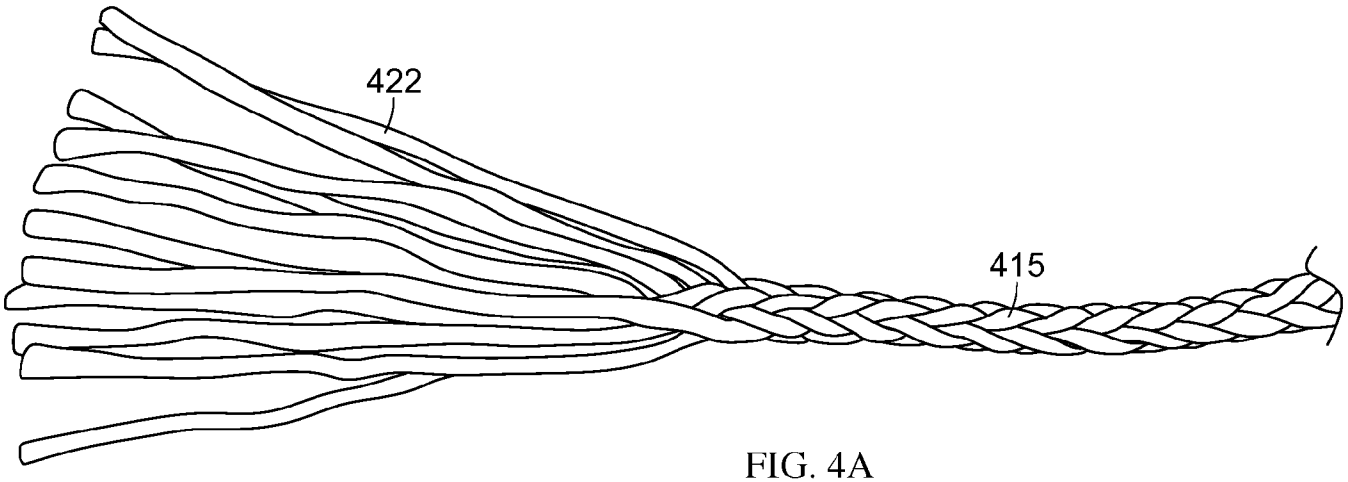
FIGS. 4A and 4B illustrate a single cord member with both braided and unbraided misaligned regions.
Figure 4B:
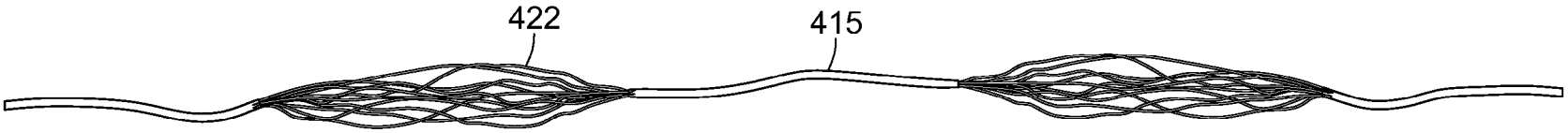

Reference is next made to FIG. 4, which illustrates a single cord member with both braided 415 and unbraided misaligned regions 422. As discussed above, a cord may be unbraided at an end region (illustrated on top) or within the length of the cord (illustrated below) without severing the cord. The unbraided sections of the cord will include the fibers defaulting toward a misaligned configuration as illustrated. The unbraided end region will allow the fibers to fan out, whereas the unbraided inline sections will allow the fibers to separate along the unbraided region as shown. These features of the unbraided fibers are utilized in splice coupling portions of a cord.

Reference is next made to FIGS. 5A-D which illustrate steps in splicing to form a continuous single loop of braided cord. The illustrated steps are applicable to various sizes and shapes of braided cord including the spliced coupling discussed above for the leg loop member. A spliced loop of cord may also be used as the coupler between the leg loop member and the waist member of a harness (i.e. belay loop). Two regions of the cord disposed in proximity to the ends may be sequentially spliced. Portions of the end regions may be partially trimmed and/or spliced to create the continuous loop. In addition, the continuous loop may be externally covered with a hollow cylindrical member to protect from abrasion and/or to increase strength. For application as a belay loop, the illustrated continuous loop may be externally covered with a rope sheath to protect the loop from abrasion during use.

Figure 5A:
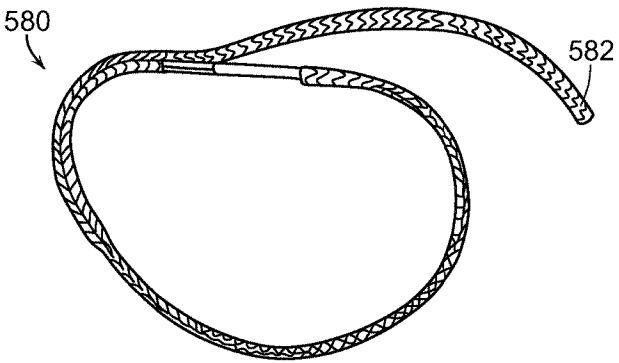
FIGS. 5A, 5B, 5C, and 5D illustrate splicing related straps of a single loop of cord.
Figure 5B:
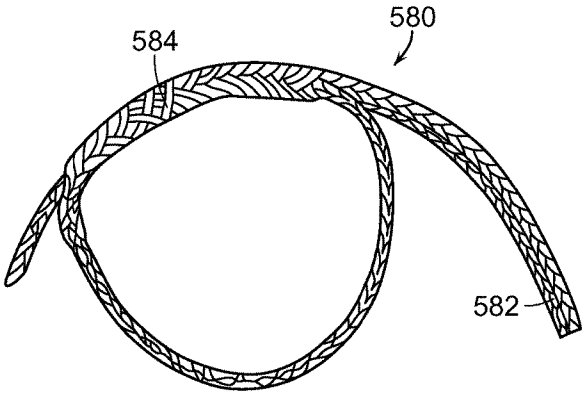
Figure 5C:
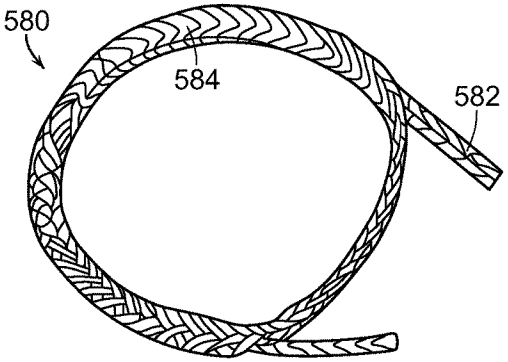
Figure 5D:
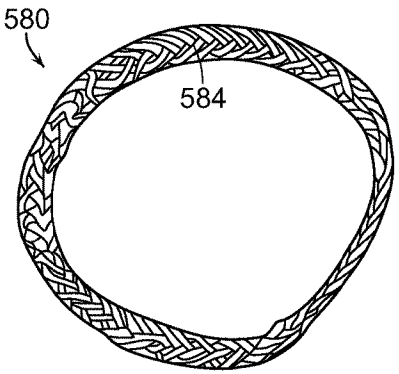

Reference is next made to FIGS. 5A-5D, which illustrate one embodiment of a cord splicing process. In particular FIGS. 5A-5D illustrate sequentially splicing the end region 582 of a cord 580 to form a continuous loop. The splice includes braiding fibers from one region with a separate region forming spliced coupling 584. As discussed above, braiding includes routing the fibers around one another in a substantially parallel configuration. The braiding process may include completely braising the end regions within the cord to avoid fraying. The spliced coupling 584 causes a tightening or binding in response to a separating or tensile force. In addition, an optional compression cover may be positioned over the cord to further prevent the braided cords from separating and/or to protect from abrasion. A continuous loop of spliced cord as shown in FIG. 5D may be used as the coupler between the leg loop member and waist member in the harness embodiments illustrated in FIGS. 1 and 2 to further reduce the weight of the overall system.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. A harness system comprising:

a waist member configured to encircle a naval region of a user, wherein the waist member forms a continuous waist loop;

a leg loop member configured to encircle a set of legs of the user, wherein the leg loop member is coupled to the waist member; and wherein the leg loop member comprises a cord, said cord having a plurality of monolithic strands including at least one braided region, at least two unbraided regions, and at least one spliced coupling, and wherein at least one of the braided regions is disposed between the unbraided regions, and wherein the unbraided regions are disposed on the leg loop member to correspond to the user's legs, and wherein the unbraided regions further comprises the plurality of separated monolithic strands oriented substantially parallel and equidistant to one another, and wherein the at least one spliced coupling is disposed on the at least one braided region.

2. The system of claim 1, wherein the leg loop member forms a continuous loop.

3. The system of claim 2, wherein the at least one spliced coupling of the leg loop member includes one spliced coupling and wherein the at least one braided region of the leg loop member includes two braided regions.

4. The system of claim 3, wherein each of the braided regions are disposed between the unbraided regions and independent of one another with respect to the continuous loop.

5. The system of claim 4, wherein a portion of the two braided regions are substantially parallel to one another.

6. The system of claim 1, wherein the leg loop member forms two continuous loops separated by a braided region.

7. The system of claim 6, wherein the two continuous loops each include a spliced coupling, two braded regions, and an unbraided region.

8. The system of claim 7, wherein the unbraided region of each of the two continuous loops is disposed between the two braided regions.

9. The system of claim 1, wherein the coupling between the leg loop member and the waist member includes a third loop extending around both the waist member and the leg loop member.

10. The system of claim 9, wherein the third loop forms a continuous loop.

11. The system of claim 10, wherein the third loop comprises a cord including a braided third region and a spliced third coupling.

12. A harness system comprising:

a waist member configured to encircle a naval region of a user, wherein the waist member forms a continuous waist loop;

a leg loop member configured to encircle a set of legs of the user, wherein the leg loop member is coupled to the waist member; and wherein the leg loop member comprises a cord, said cord having a plurality of monolithic strands including at least one braided region, at least two unbraided regions, and at least one spliced coupling, and wherein at least one of the braided regions is disposed between the unbraided regions, and wherein the unbraided regions are disposed on the leg loop member to correspond to the user's legs, and wherein the unbraided regions further comprise the plurality of monolithic strands which are separated and oriented substantially parallel and equidistant to one another, and wherein the at least one spliced coupling is disposed on the at least one braided region, and wherein the leg loop member forms a continuous loop.

13. A method for manufacturing a harness comprising the acts of:

providing a waist member configured to encircle the naval region of a user, wherein the waist member forms a continuous waist loop;

providing a leg loop member coupled to the waist member and encircling the legs of the user, wherein the leg loop member comprises a cord of braided strands including a braided region with two ends and a middle;

splice coupling the two ends of the cord to form at least one spliced coupling; and unbraiding at least two separated portions of the middle region to form unbraided regions oriented on the leg loop member to correspond to the user's legs and disposed on opposite sides of a portion of the braided region.

14. The method of claim 13, wherein the act of splice coupling the two end regions of the cord to form at least one spliced coupling includes splice coupling the two end regions to one another thereby forming a continuous loop.

15. The method of claim 13, wherein the act of splice coupling the two end regions of the cord to form at least one spliced coupling includes splice coupling the two end regions to the middle region thereby forming two continuous loops.

16. The method of claim 13, wherein the act of splice coupling includes interweaving the individual strands.

17. The method of claim 13, wherein the act of unbraiding at least two separated portions of the middle region to form unbraided regions includes unweaving the individual strands and orienting the individual strands to be substantially parallel and equidistant from one another across the unbraided regions.

18. The method of claim 13, wherein the coupling between the leg loop member and the waist member includes a third loop extending around both the waist member and the leg loop member.

19. The method of claim 13, wherein the third loop forms a continuous loop.

20. The method of claim 13, wherein the third loop comprises a cord including a braided third region and a spliced third coupling.

* * * * *